US007578657B2

(12) United States Patent
Kowalak et al.

(10) Patent No.: US 7,578,657 B2
(45) Date of Patent: Aug. 25, 2009

(54) ENCLOSED PUMP SWITCH LEVEL CONTROL SYSTEM

(75) Inventors: Mark Kowalak, Troy, OH (US); Kirk Neer, Sidney, OH (US); Stephen Pasley, Springboro, OH (US)

(73) Assignee: Crane Pumps & Systems, Inc., Piqua, OH (US)

( * ) Notice: Subject to any disclaimer, the term of this patent is extended or adjusted under 35 U.S.C. 154(b) by 541 days.

(21) Appl. No.: 10/504,730

(22) PCT Filed: Feb. 18, 2003

(86) PCT No.: PCT/US03/04995

§ 371 (c)(1),
(2), (4) Date: Apr. 25, 2005

(87) PCT Pub. No.: WO03/071133

PCT Pub. Date: Aug. 28, 2003

(65) Prior Publication Data

US 2005/0175466 A1 Aug. 11, 2005

Related U.S. Application Data

(60) Provisional application No. 60/357,460, filed on Feb. 15, 2002.

(51) Int. Cl.
*F04B 49/00* (2006.01)

(52) U.S. Cl. ..... 417/38; 417/44.2; 417/297.5

(58) Field of Classification Search ..... 417/38, 417/39, 44.2, 297.5; 700/240, 281, 301; 73/1.101, 290 R, 299, 301, 302, 296 B; 137/393, 137/403, 406, 407, 408, 453; 200/83 W
See application file for complete search history.

(56) References Cited

U.S. PATENT DOCUMENTS

| | | | | | |
|---|---|---|---|---|---|
| 1,698,969 | A | * | 1/1929 | Sartakoff | 73/316 |
| 2,488,506 | A | * | 11/1949 | Bernhardt | 417/18 |
| 3,123,689 | A | | 3/1964 | Baker | |
| 3,154,652 | A | * | 10/1964 | Gilman | 200/83 W |
| 3,421,538 | A | | 1/1969 | Hembree | |
| 3,679,326 | A | | 7/1972 | Weber | |
| 3,853,006 | A | * | 12/1974 | Lawford | 73/301 |
| 4,375,764 | A | * | 3/1983 | Lawford et al. | 73/301 |
| 4,409,833 | A | * | 10/1983 | Thomson et al. | 73/302 |
| 4,780,862 | A | * | 10/1988 | Clerke | 367/166 |
| 5,906,374 | A | | 5/1999 | Arbuckle | |
| 6,076,399 | A | * | 6/2000 | Free et al. | 73/304 R |
| 6,274,009 | B1 | * | 8/2001 | Krafton et al. | 204/230.2 |

* cited by examiner

*Primary Examiner*—Devon C Kramer
*Assistant Examiner*—Dnyanesh Kasture
(74) *Attorney, Agent, or Firm*—Standley Law Group LLP

(57) ABSTRACT

An arrangement (10) for controlling the liquid level in a basin (60) by selectively actuating a pump (64) has an environmentally-sealed enclosure (22) with an internal volume subject to thermal and pressure effects. A first (14) and a second (16) pressure sensing means are positioned in the enclosure and a barrier fluid (18) fills a balance of the internal volume. The first sensing means (14) is in a first chamber (22*a*) of the enclosure (22) and the second sensing means (16) is in a second chamber (22*b*). The barrier fluid (18) has a first portion (18*a*) in the first chamber (22*a*) and a second portion in the second chamber (22*b*). The first pressure sensing means (14) communicates an "on/off" signal to the pump (64). Diaphragms (26, 40) in the respective chambers (22*a*, 22*b*) allow the device to adjust to changes in atmospheric pressures. The barrier fluid (18) is electrically non-conductive, chemically non-reactive with any materials comprising the pressure sensing means and, preferably, an oil.

14 Claims, 3 Drawing Sheets

ENCLOSED PUMP SWITCH LEVEL CONTROL SYSTEM

The present invention relates to a level control system for a pump, particularly a pump used in a sewage basin to signal when a pump should be turned on or off. Because the present invention provides a level control system which is enclosed, it provides significant advantages over the known prior art, as the critical level sensing components are not exposed to the contents of the basin.

BACKGROUND OF THE ART

In many sewage basin applications, pressure switches of conventional design are used to provide an on/off switching and an alarm signal when an alarm level is exceeded even while the pump is attempting to lower the level. Many of these designs utilize an "air bell" to isolate the switch port from the sewage environment. This "air bell," which acts like an inverted glass under water, uses the compressibility of air in the bell to transmit level changes in the liquid at the opening of the bell. However, when small changes in liquid level, on the order of a few inches of water, need to be detected, there must be a vent to atmosphere to compensate for the atmospheric pressure changes, so that weather and elevation do not cause the set points to shift. This atmospheric venting offers an opportunity for moisture to get to the switch or its components.

A further problem with the air bell is that changes in the amount of gas in the air bell can also shift actuation points. One reason for air loss in the air bell is leaky fittings. Another reason is oxygen consumption due to decomposition of sewage materials in the basin, which can be especially troublesome when the sewage basin is only used for portions of the year, as with a summer cabin. A yet third reason could be the entry of methane or other decomposition gases into the air bell at the liquid-gas interface.

In the known prior art, these problems with air bells have been cured by lifting the level control system completely out of the sewage liquids and resetting it into place, recapturing the air in the bell. This solution has many problems, including the undesirability to have to open the sewage basin and to move the level control system.

It is therefore an object of the present invention to provide an environmentally sealed pressure level switch control in which at least the on/off switch is provided such that it does not use an air bell that must be vented to atmosphere.

SUMMARY OF THE INVENTION

This and other advantages of the present invention are achieved by a device for controlling the liquid level in a basin by selectively actuating a pump. The device has an environmentally-sealed enclosure, with first and second pressure sensing means positioned in the enclosure; and a barrier fluid. The enclosure has an internal volume filled with the barrier fluid. In the embodiment taught, the enclosure comprises separate first and second chambers.

In some embodiments, the first pressure sensing means is a differential pressure switch positioned in the first chamber and the second pressure sensing means is a differential pressure switch positioned in the second chamber. In such embodiments, a first portion of the barrier fluid is contained in the first chamber and a separate second portion of the barrier fluid is contained in the second chamber. The first differential pressure switch is in electrical communication with the pump and provides an "on/off" signal therefor. The first differential pressure switch has a low pressure side and a high pressure side, with the low pressure side thereof exposed to the first portion of the barrier fluid and the high pressure side thereof exposed to the second portion of the barrier fluid. In such an embodiment, the high pressure side of the first differential pressure switch is mounted into a portion of the first chamber that connects the first and second chambers and that isolates the respective first and second portions of barrier fluid.

In some embodiments, a diaphragm in a wall of the second chamber is reactive to atmospheric pressure changes external to the diaphragm, so that the pressure in the second portion of the barrier fluid at the diaphragm varies according to variations in the atmospheric pressure; and a diaphragm in a wall of the first chamber is reactive to pressure changes external to the diaphragm, so that the pressure in the first portion of the barrier fluid at the diaphragm varies according to variations in atmospheric pressure and in a liquid head exerted at the external side of the diaphragm.

In some embodiments, the second differential pressure switch is in electrical communication with an alarm and provides a "high level" alarm signal therefor. In these embodiments, the second differential pressure switch has a low pressure side and a high pressure side, the low pressure side thereof being exposed to the second portion of the barrier fluid and the high pressure side thereof being exposed to the pressure in the basin external to the second chamber.

The barrier fluid is electrically non-conductive and chemically non-reactive with any materials comprising the differential pressure switches. It is preferred to be an oil.

BRIEF DESCRIPTION OF THE DRAWINGS

The present invention will be better understood when reference is made to the accompanying figures, wherein identical parts are identified with identical reference numerals and wherein.

DETAILED DESCRIPTION OF THE PREFERRED EMBODIMENT

Figure 1:
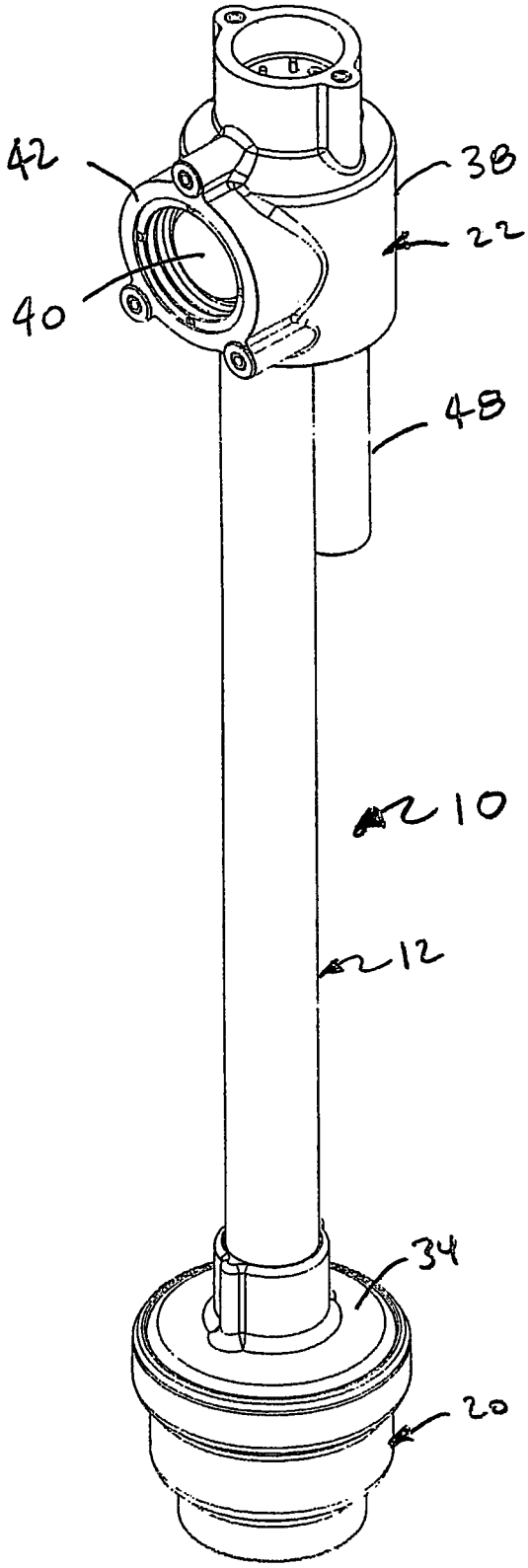
FIG. 1 shows a perspective view of a pump switch level control system having the features of the present invention.
Figure 2:
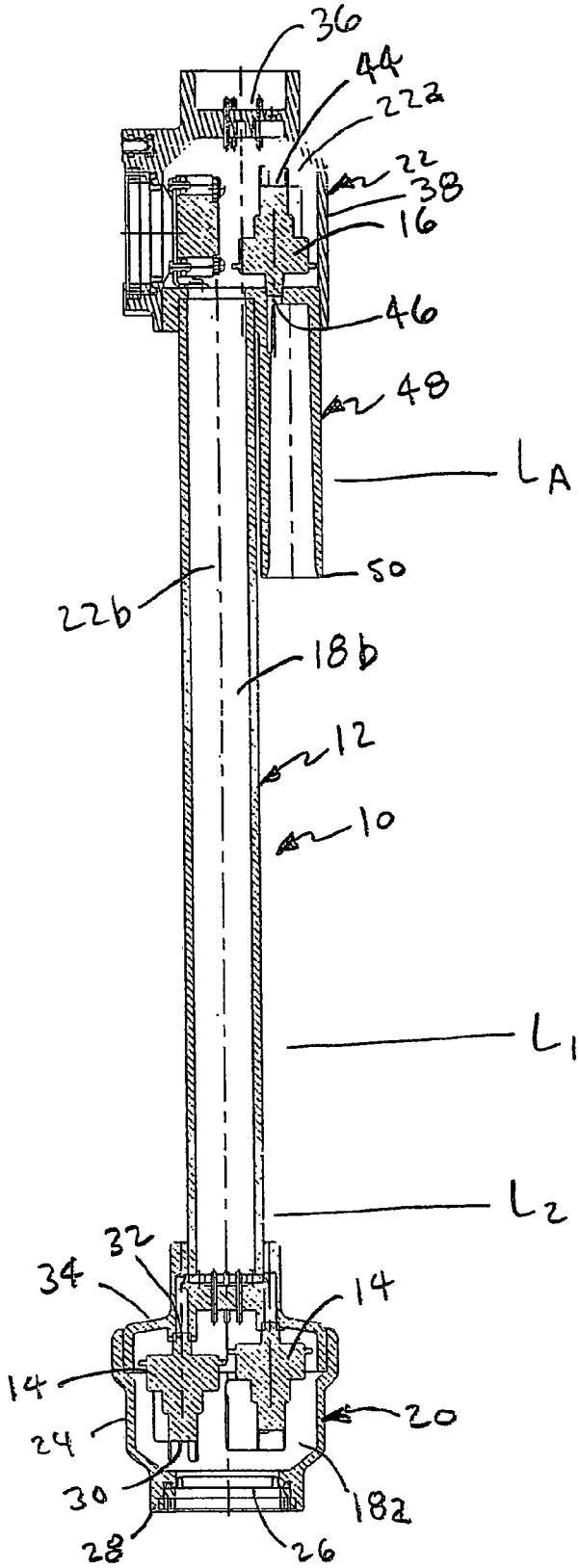
FIG. 2 shows a side section view of the invention.
Figure 3:
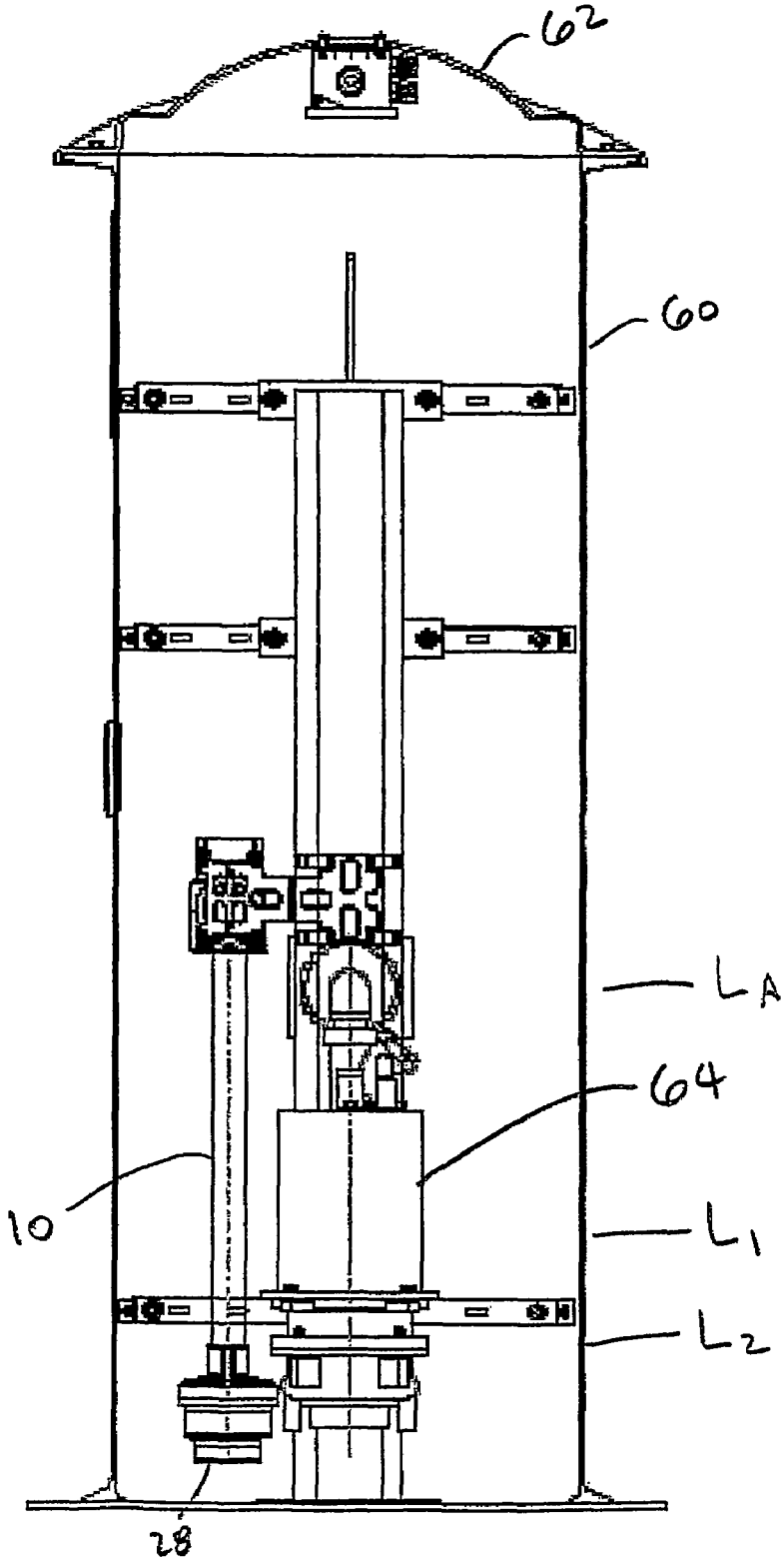
FIG. 3 shows a side section view of the invention in a conventional use environment.

FIGS. 1 though 3 show the present invention device 10, as will be explained in more detail. FIG. 1 shows the device 10 in isolation; FIG. 2 shows a side sectional view of the device and FIG. 3 shows the device 10 in a conventional use environment.

The device 10 comprises an environmentally-sealed enclosure 12, with a first and a second pressure sensing means 14, 16 positioned in the enclosure. The balance of the internal volume of the enclosure is filled with a barrier fluid 18, although the barrier fluid will comprise first and second portions 18*a*, 18*b*. As will be seen, these portions 18*a*, 18*b* are isolated from each other in operation. The barrier fluid 18 selected will be a non-conductive fluid, typically an oil, so that the barrier fluid does not adversely affect operation of the differential pressure switches. The barrier fluid should be essentially incompressible at pressures around ambient and that it be generally non-reactive with any components of the differential pressure switches 14, 16.

In the particular embodiment of the device 10 shown in FIG. 1, the enclosure 12 is divided into two separate chambers 20, 22. The first or lower chamber 20 contains the first pressure sensing means, which in this case is shown as a differential pressure switch 14, which serves as an "on/off" switch for the pump. In the specific case shown, the lower chamber 20 is provided with two first pressure sensing means, in the form of two differential pressure switches 14, so that there is a system redundancy, but the system may operate with only one first pressure sensing means, if desired. The second or upper chamber 22 contains the second differential pressure switch 16, which serves a high-level alarm function for the pump. Although a variety of differential pressure switches are manufactured by a variety of manufacturers, a typical switch suitable for this application is a diaphragm switch from Barksdale, Inc.

The operation of the first pressure sensing means 14 will be understood by examining its position in the first chamber 20. Generally, the outer wall 24 of the first chamber 20 will be sufficiently thick and rigid that it will not flex as a result of pressure changes that are due to either atmospheric pressure changes or pressure changes due to the head of water in the basin in which the chamber is positioned. However, a portion of the wall 24 is a diaphragm 26, which is intended to be reactive to pressure changes, particularly pressure changes due to the water head in the basin. In the particular embodiment shown, the diaphragm 26 is shown as being presented on a bottom surface 28 of the first chamber 20, which also serves as the bottom surface of the enclosure. This bottom surface 28 does not rest directly upon the bottom of the basin, so the diaphragm 26 is exposed at all times to the local pressure of the liquid in the basin at that level. That local pressure will be a function of both the head of the liquid above the diaphragm 26 and the atmospheric pressure above the liquid head.

In the embodiment illustrated, the first differential pressure switch 14 is a conventional switch with a low pressure side 30 and a high pressure side 32. The low pressure side 30 will be exposed to the portion 18*a* of the barrier fluid that is contained in the first chamber 20. The high pressure side 32 of the first differential pressure switch 14 will be exposed to the second portion 18*b* of the barrier fluid, and particularly, the head that it exerts. In addition to that head, the pressure of the second portion 18*b* of barrier fluid on the first differential pressure switch 14 will vary with atmospheric pressure variations because of a diaphragm in the second chamber 22, as explained below. To expose the high pressure side 32 of the first differential pressure switch 14 to the second barrier fluid portion 18*b*, the switch is mounted into a top portion 34 of the first chamber. This top portion serves the purposes of isolating the first and second portions 18*a*, 18*b* of barrier fluid from each other while simultaneously isolating both portions from the sewage materials in the basin. The top portion 34 also serves to connect the first or lower chamber 20 or enclosure 12 with the second or upper chamber 22. In setting the switch mechanism (not shown) of the first differential pressure switch 14, appropriate levels will be determined in the basin such that the pump will be turned on when the liquid level in the basin reaches or exceeds a certain level $L_1$ and the pump will continue to operate until the level is reduced to a certain level $L_2$, at which point the switch 14 will turn off the pump. Clearly, this switching function requires a signal communication between the switch 14 and the pump. While this signal communication is not shown explicitly in FIG. 1, the person of ordinary skill will know how to provide this communication, typically through a wire connecting the switch 14 to a quick-connect cord entry 36 provided at a top end of the second chamber 22. In the particular embodiment of the invention that is anticipated, the switch 14 will be a normally-closed switch that is tripped by the higher pressure of the head of barrier fluid 18*b* until the pressure of barrier fluid 18*a* increases due to an increasing liquid level in the basin and counteracts the head of barrier fluid 18*b*.

Attention is now directed to the second pressure sensing means, which in the embodiment illustrated is a differential pressure switch 16, located in the second chamber 22. Note that this second chamber really comprises an upper portion 22*a* and a lower portion 22*b*, which are in liquid communication so that barrier fluid 18*b* moves freely between them. The second chamber 22, and particularly upper portion 22*a*, will have an outer wall 38 that is sufficiently thick and rigid that it will not flex as a result of pressure changes that are due to atmospheric pressure changes. However, a portion of the wall 38 is a diaphragm 40, which is intended to be reactive to pressure changes, particularly atmospheric pressure changes. In the particular embodiment shown, the diaphragm 40 is shown as being presented on a side surface 42 of the second chamber 22, particularly at a point well above the highest liquid level anticipated to be encountered. The reaction of the diaphragm 40 is directly transmitted to the second portion 18*b* of barrier fluid in the second chamber 22. For that reason, the pressure acting on the high pressure side of first switch 14 will vary with changes in the atmospheric pressure. It should also be understood that the diaphragm 26 in the first chamber 20 will also be reactive to atmospheric pressure changes, since the total pressure bearing upon the diaphragm 26 will be the sum of the atmospheric pressure and the head pressure due to liquid in the basin.

In the embodiment disclosed, the second differential pressure switch 16 will be a conventional switch with a low pressure side 44 and a high pressure side 46, and will typically be identical to the first differential switch 14 used in the first chamber 20. The low pressure side 44 will be exposed to the portion 18*b* of the barrier fluid that is contained in the second chamber 22. The high pressure side 46 of the second differential pressure switch 16 will be exposed to an alarm air bell 48 constructed to expose the high pressure side to the pressure internal to the basin. The air bell 48 will generally be of conventional construction and should be effective, since the normal operational levels of the basin liquid level will be far below the bottom 50 of the air bell, allowing the air bell to be continuously recharged. In setting the switch mechanism (not shown) of the second differential pressure switch 16, appropriate levels will be determined in the basin such an alarm is triggered if the liquid level in the basin reaches or exceeds a certain level $L_A$. Clearly, this switching function requires a signal communication between the switch 16 and the pump. While this signal communication is not shown explicitly, the person of ordinary skill will know how to provide this communication, typically through a wire connecting the switch 16 to the quick-connect cord entry 36 provided at a top end of the second chamber 22. A solid-state relay 52 may be provided in some cases where it is necessary to condition the output signal of one or more of the switches 14, 16, and use of such a relay would be within the knowledge of one of ordinary skill.

The lower portion 22*b* of the second chamber is provided to provide an appropriate head of the barrier fluid 18*b*, while also allowing the diaphragm 26 in the first chamber to be positioned sufficiently low in the basin to assure proper operation by keeping it below the liquid level in the basin. Lower portion 22*b* needs to maintain fluid communication for barrier fluid 18*b* throughout the second chamber 22, so that variations in atmospheric pressure detected at diaphragm 40 are transmitted through barrier fluid 18*b* to the high pressure side 32 of first pressure switch 14. In the embodiment shown, this lower portion 22*b* is essentially a cylindrical conduit with a rigid wall.

The ability of the device 10 of the present invention to react appropriately to liquid level and atmospheric pressure changes will be determined by a few factors, and the exact design will be understood to one of ordinary skill once the overall concept of the device is understood. First, the area of the two diaphragms 26, 40 and the flexibility thereof (inwardly or outwardly) will define a reactive volume, which must be considered relative to the volumes of the incompressible barrier fluid in the two chambers. It is important to keep the reactive volume of diaphragms as high as possible when compared to the volumes of the incompressible barrier fluid to assure good operation. For this reason, the actual volumes of the two portions of the barrier fluid should be maintained as low as possible. This may be achieved in several different ways. One way is to minimize the amount of volume inside the device which is subject to thermal or pressure effects.

Because both the first and second chambers have a diaphragm associated therewith, the barrier fluid may be sealed in place at a place of manufacture and the completed device, in this sealed condition, may be used at various altitude and pressure conditions without any adjustment being required.

In FIG. 3, the device 10 is shown in the environment of a basin 60 having a removable basin cap 62 and containing a pump 54, typically a grinder pump. The switch set levels $L_1$, $L_2$ and $L_4$ are also shown.

What is claimed is:

1. An arrangement for controlling the liquid level in a basin by selectively actuating a pump, the arrangement comprising:

an environmentally-sealed enclosure, having an internal volume comprising separate first and second chambers and subject to thermal and pressure effects;

a barrier fluid, filling a balance of the internal volume, with a first portion thereof contained in the first chamber and a separate second portion thereof contained in the second chamber;

a first differential pressure switch positioned in the first chamber, the first differential pressure switch having low and high pressure sides, the low pressure side exposed to the first portion of the barrier fluid and the high pressure side exposed to the second portion of the barrier fluid; and a second differential pressure switch positioned in the second chamber, the second differential pressure switch having low and high pressure sides, the low pressure side exposed to the second portion of the barrier fluid and the high pressure side exposed to the pressure in the basin external to the second chamber.

2. The liquid level control arrangement of claim 1, wherein the first differential pressure switch is in electrical communication with the pump and provides an "on/off" signal therefor.

3. The liquid level control arrangement of claim 1, wherein:

the high pressure side of the first differential pressure switch is mounted into a portion of the first chamber that connects the first and second chambers and that isolates the respective first and second portions of barrier fluid.

4. The liquid level control arrangement of claim 1, wherein:

a diaphragm in a wall of the second chamber is reactive to atmospheric pressure changes external to the diaphragm, so that the pressure in the second portion of the barrier fluid at the diaphragm varies according to variations in the atmospheric pressure; and a diaphragm in a wall of the first chamber is reactive to pressure changes external to the diaphragm, so that the pressure in the first portion of the barrier fluid at the diaphragm varies according to variations in atmospheric pressure and in a liquid head exerted at the external side of the diaphragm.

5. The liquid level control of claim 1, wherein:

the second differential pressure switch is in electrical communication with an alarm and provides a "high level" alarm signal therefor.

6. The liquid level control arrangement of claim 1, wherein the barrier fluid is electrically non-conductive.

7. The liquid level control arrangement of claim 6, wherein the barrier fluid is chemically non-reactive with any materials comprising the first differential pressure switch.

8. The liquid level control arrangement of claim 7, wherein the barrier fluid is an oil.

9. The liquid level control arrangement of claim 1, wherein the barrier fluid is electrically non-conductive.

10. The liquid level control arrangement of claim 9, wherein the barrier fluid is chemically non-reactive with any materials comprising the differential pressure switches.

11. The liquid level control arrangement of claim 10, wherein the barrier fluid is an oil.

12. The liquid level control arrangement of claim 1, wherein the first differential pressure switch is in electrical communication with the pump and provides an "on/off" signal therefor.

13. The liquid level control arrangement of claim 1, wherein:

the high pressure side of the first differential pressure switch is mounted into a portion of the first chamber that connects the first and second chambers and that isolates the respective first and second portions of barrier fluid.

14. The liquid level control arrangement of claim 1, wherein:

a diaphragm in a wall of the second chamber is reactive to atmospheric pressure changes external to the diaphragm, so that the pressure in the second portion of the barrier fluid at the diaphragm varies according to variations in the atmospheric pressure; and a diaphragm in a wall of the first chamber is reactive to pressure changes external to the diaphragm, so that the pressure in the first portion of the barrier fluid at the diaphragm varies according to variations in atmospheric pressure and in a liquid head exerted at the external side of the diaphragm.

* * * * *

UNITED STATES PATENT AND TRADEMARK OFFICE

CERTIFICATE OF CORRECTION

PATENT NO. : 7,578,657 B2
APPLICATION NO. : 10/504730
DATED : August 25, 2009
INVENTOR(S) : Kowalak et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 1084 days.

Signed and Sealed this

Seventh Day of September, 2010

David J. Kappos

David J. Kappos
*Director of the United States Patent and Trademark Office*